US010154698B2

(12) United States Patent
Loveland

(10) Patent No.: US 10,154,698 B2
(45) Date of Patent: Dec. 18, 2018

(54) SLIP SYSTEM

(71) Applicant: modbod, Inc., Draper, UT (US)

(72) Inventor: Amanda Loveland, Alpine, UT (US)

(73) Assignee: modbod, Inc, Draper, UT (US)

( * ) Notice: Subject to any disclaimer, the term of this patent is extended or adjusted under 35 U.S.C. 154(b) by 0 days.

(21) Appl. No.: 15/846,019

(22) Filed: Dec. 18, 2017

(65) Prior Publication Data

US 2018/0168251 A1 Jun. 21, 2018

Related U.S. Application Data

(60) Provisional application No. 62/435,257, filed on Dec. 16, 2016.

(51) Int. Cl.

| | |
|---|---|
| ***A41D 15/00*** | (2006.01) |
| ***A41B 9/10*** | (2006.01) |
| ***A41D 1/14*** | (2006.01) |
| ***A41D 1/22*** | (2018.01) |

(52) U.S. Cl.

CPC ..... *A41D 15/002* (2013.01); *A41B 9/10* (2013.01); *A41D 1/14* (2013.01); *A41D 1/22* (2013.01); *A41D 15/005* (2013.01)

(58) Field of Classification Search

CPC ..... A41D 15/00; A41D 15/02; A41D 1/22; A41D 27/10; A41B 9/08

See application file for complete search history.

(56) References Cited

U.S. PATENT DOCUMENTS

| | | | | |
|---|---|---|---|---|
| 2,117,449 A | | 5/1938 | Porter | |
| 2,498,332 A | | 2/1950 | Brick | |
| 2,899,962 A | * | 8/1959 | Entringer et al. | A41B 9/08 2/211 |
| 3,002,193 A | * | 10/1961 | Briskman | A41D 1/00 2/72 |
| 3,064,265 A | * | 11/1962 | Bridgewaters | A41D 15/002 2/105 |
| 3,665,516 A | * | 5/1972 | Orovan | A41D 15/002 2/211 |
| 3,883,896 A | * | 5/1975 | Cain | A41D 15/002 2/211 |
| 4,377,007 A | * | 3/1983 | Sudjian | A41D 15/002 2/105 |

(Continued)

FOREIGN PATENT DOCUMENTS

GB 2189376 A 10/1987

OTHER PUBLICATIONS

United States Patent and Trademark Office Acting as the International Search Authority, "International Search Report" and "Written Opinion," dated Feb. 14, 2018 in international patent application No. PCT/US2017/067121.

*Primary Examiner* — Tejash Patel
(74) *Attorney, Agent, or Firm* — Durham Jones & Pinegar, P.C., Intellectual Property Law Group

(57) ABSTRACT

A slip system includes a skirt or a slip with an adjustable length. The skirt may be a standalone skirt or part of a dress. The slip may be a full slip or a half slip. In addition to the skirt or slip, the slip system includes one or more removable, replaceable sections. Each removable, replaceable section may add to the length of a main body of the skirt or slip. Each removable, replaceable section may impart the skirt or slip with a desired appearance by providing variety in a design and/or style of the skirt or slip.

20 Claims, 3 Drawing Sheets

(56) References Cited

U.S. PATENT DOCUMENTS

| | | | | |
|---|---|---|---|---|
| 5,173,965 | A * | 12/1992 | Panner | A41D 15/002 2/105 |
| 6,408,438 | B1 * | 6/2002 | McKee | A41D 15/002 2/244 |
| 9,364,035 | B1 * | 6/2016 | Shachaf | A41D 15/00 |
| 2016/0021950 | A1 | 1/2016 | Rafieiankopaei | |

* cited by examiner

SLIP SYSTEM

CROSS-REFERENCE TO RELATED APPLICATION

A claim for the benefit of priority to the Dec. 16, 2016 filing date of U.S. Provisional Patent Application 62/435,257, titled SLIP DRESS SYSTEM ("the '257 Provisional Application"), is hereby made pursuant to 35 U.S.C. § 119(e). The entire disclosure of the '257 Provisional Application is hereby incorporated herein.

TECHNICAL FIELD

This disclosure relates generally to skirts, including standalone skirts and skirts of dresses, and slips that have adjustable lengths. More specifically, this disclosure relates to skirts and slips with one or more removable, replaceable sections that enable adjustment of the lengths of the skirts or slips. This disclosure also relates to skirts and slips with one or more removable, replaceable sections that enable individuals to modify an appearance of the skirt or slip. Methods for modifying a skirt or a slip are also disclosed.

RELATED ART

Some women want to feel fashionable, comfortable, and modest. For many women, finding a desirable combination of fashion, comfort, and modesty can be challenging. There are many problems that can come from trying to feel and look fashionable. For example, women who want to wear less revealing attire might struggle to find dresses that cover their knees and arms. Some women need to cover certain portions of their body, such as the top of their knees or their shoulders, for religious or other reasons.

Women often find dresses they would like to wear, but cannot wear because of fit or coverage. For example, a dress could have a desirable length, but its bodice might not meet certain criteria (e.g., needs or desires). In such an instance, a woman might need to find something else to layer under or over the bodice to provide the desired coverage, which adds to the cost of the dress. When women layer additional items of clothing with a dress to provide the needed or desired coverage, the additional items of clothing often interfere with the intended design and/or fit of the dress, typically making it appear less fashionable. For instance, additional layers of clothing may detract from the slimming appearance of a dress or a skirt, instead creating wrinkles, bumps, and/or lumps.

In an effort to avoid the detrimental effects of layering, some women opt for tailoring to provide a desired level of coverage. Although tailoring may modify a dress while at least partially maintaining its fashionability and without detracting from its intended fit, tailoring can dramatically increase the cost of a dress.

SUMMARY

This disclosure relates to alternative ways to fashionably modify the appearance of a skirt or a slip. As used in this disclosure, the term "skirt" refers to standalone skirts and to the skirt portions of dresses. Likewise, a slip may comprise a full slip, which is hung from the shoulders, or a waist slip or half slip, which is held around the waist. A skirt or a slip may include one or more sections that may be removed from and/or replaced on a bottom portion of a main body of the skirt or slip (i.e., the portion of the skirt or slip that includes a top of the skirt and, thus, surrounds the wearer's waist and hips). Together, the main body and one or more removable, replaceable sections of a skirt or a slip may also be referred to as a "slip system."

The main body of a skirt or slip of this disclosure may have any of a variety of different types or styles. Without limitation, the main body may be an A-line type, a pencil type, a pleated type, or any other type or style of skirt.

The main body of a skirt or slip can be worn by itself as a short skirt, a short dress, or a short slip (e.g., micro length, mini length, knee-length, etc.). Nevertheless, the main body is capable of being lengthened. At or adjacent to its hem, the main body includes a connector. The connector may be located on an outer surface of the main body, at a bottom edge of the hem, or on an inner surface of the main body. In some embodiments, the connector may comprise one side of a zipper. Other types of connectors may also be used.

One or more of the removable, replaceable sections of a slip system may be selectively used to add to the length of the main body of the skirt or slip and/or to shorten the length of the skirt or slip. A removable, replaceable section that is to be used as a portion of a skirt or slip that at least partially lacks a slit may comprise a loop. A removable, replaceable section that is to be used along a portion of a skirt or slip that includes a slit (e.g., to extend a slit of the skirt or slip, etc.) may comprise a strip to enable continuation of the slit in the skirt or slip.

In some embodiments, the slip system may include one removable, replaceable section. In other embodiments, the slip system may include a plurality of removable, replaceable sections. Each removable, replaceable section of the slip system may include an upper connector, which is configured complementarily to the connector at or near the bottom of the main body of the skirt or slip, and which is capable of engaging, mutually engaging, or being engaged by the connector at or near the bottom of the main body of the skirt or slip.

In addition to the upper connector, a removable, replaceable section of a slip system may also include a lower connector. The lower connector of a removable, replaceable section of a slip system may enable that removable, replaceable section to receive another, lower removable, replaceable section of the slip system. More specifically, the lower connector of a removable, replaceable section may be configured complementarily to an upper connector or another removable, replaceable section, and be capable of engaging, mutually engaging, or being engaged by an upper connector of another removable, replaceable section.

In embodiments where the slip system includes a single removable, replaceable section, the removable, replaceable section may lack a lower connector. Alternatively, the removable, replaceable section of such a slip system could include a lower connector. The lower connector of such a removable, replaceable section may be part of its design, enable further lengthening of the skirt or slip, or be included for any of a variety of other reasons.

In embodiments where the slip system includes a plurality of removable, replaceable sections, all of the removable, replaceable sections may include upper connectors and lower connectors. Alternatively, a lowermost removable, replaceable section of a slip system that includes a plurality of removable, replaceable sections may have an upper connector but lack a lower connector.

When a plurality of removable, replaceable sections is arranged in sequence below a main body of a skirt or a slip, the main body and/or the removable, replaceable sections may be substantially flush with one another, providing the appearance of seams between adjacent sections. Such an appearance may be achieved by a main body connector and a removable, replaceable section lower connector that are arranged along the bottom edges of the hems of the main body and removable, replaceable section, respectively. Alternatively, a hem or trim at the bottom of the main body and/or at least one of the removable, replaceable sections of a slip system may be capable over overlapping an upper portion of a next-lower removable, replaceable section, providing the skirt or slip with an imbricate appearance.

A removable, replaceable section of a slip system according to this disclosure may have a design that is consistent and, optionally, continuous with a design of a remainder of the slip system (e.g., the main body, any other removable, replaceable sections, etc.). Alternatively, one or more removable, replaceable sections that enable some level of customization of the skirt may be included in the slip system. By way of example only, a pattern and/or color of a removable, replaceable section may differ from a pattern and/or color of the main body of the skirt and/or from a pattern and/or color of one or more other removable, replaceable sections of the slip system.

One or more removable, replaceable sections of a slip system may also enable a wearer to customize a style of the skirt or slip. Without limitation, one or more pencil style removable, replaceable sections may be used with a pencil style main body to lengthen the skirt or slip with a continued pencil style. As another example, one or more flared removable, replaceable sections may be used with a pencil style main body to cause the skirt or slip to flare below the pencil style main body. As yet another example, one or more pleated removable, replaceable sections may be used with a pleated type main body, an A-line type main body, or a pencil type main body.

Other design aspects may also be incorporated into a skirt or slip by selecting and adding one or more removable, replaceable sections to a main body of the skirt or slip. Without limitation, a slit may be incorporated into a skirt or slip by way of a removable, replaceable section that includes a slit. The location of a removable, replaceable section with a slit along the length of the slip system may determine the location of the slit along the length of the skirt or slip. The length of the slit may be extended as the length of the skirt or slip is extended with one or more additional removable, replaceable sections.

In embodiments where the slip system is part of a dress or a full slip, the dress or full slip may be reversible from front to back. The bodice, or top, of such a dress or full slip may include an asymmetric neck line, which may differ from one side (front/back) of the bodice to the other side of the bodice. As an example, the height of the neck line of the bodice may differ from one side of the bodice to the other. When worn in a first orientation, with the lower portion of the neck line in front, the bodice may be more revealing from the front, whereas the less revealing neck line of the bodice may be worn in front in a reverse, second orientation. As another example, the style of the neck line (e.g., bateau/boat, jewel, scoop, U-neck, V-neck, rounded, square, sweetheart, keyhole, etc.) may differ from one side of the bodice to the other. In yet another example, the trim, if any, on the neckline may differ from one side of the bodice to the other.

Methods for modifying a dress, a skirt, or a slip are also disclosed. Such a method may include adjusting the length of a skirt (of a standalone skirt or a dress) or a slip (of a full slip or a half slip) by adding one or more removable, replaceable sections to a main body of a slip system or removing one or more removable, replaceable sections from the main body. Such a method may include modifying a design or style of a main body of a skirt or a slip by selecting one or more removable, replaceable sections that will provide the desired design or style. In embodiments where the skirt is part of a dress or the slip is a full slip, the dress or full slip may be worn in a front-to-back orientation that will provide a desired bodice appearance from the front and/or back of the dress or full slip.

Other aspects, as well as features and advantages of various aspects, of the disclosed subject matter will become apparent to those of ordinary skill in the art through consideration of the ensuing description, the accompanying drawings, and the appended claims.

DETAILED DESCRIPTION

A slip system with one or more removable, replaceable sections is disclosed. While the attached drawings and the ensuing description are intended to provide a general description of some embodiments of slip systems, their manufacture, and their uses, those of ordinary skill in the art will appreciate that a slip system that incorporates teachings of this disclosure may be embodied by a variety of ways.

Figure 1:
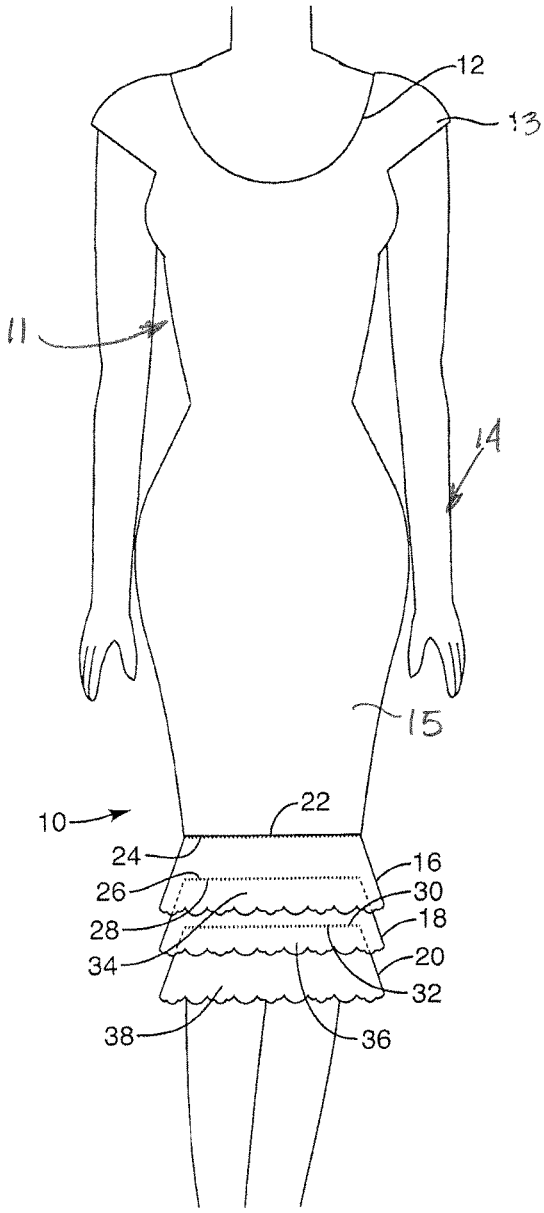
FIG. 1 shows an embodiment of a slip system according to this disclosure, in which the slip system is part of a dress or a full slip, respectively.
Figure 2:
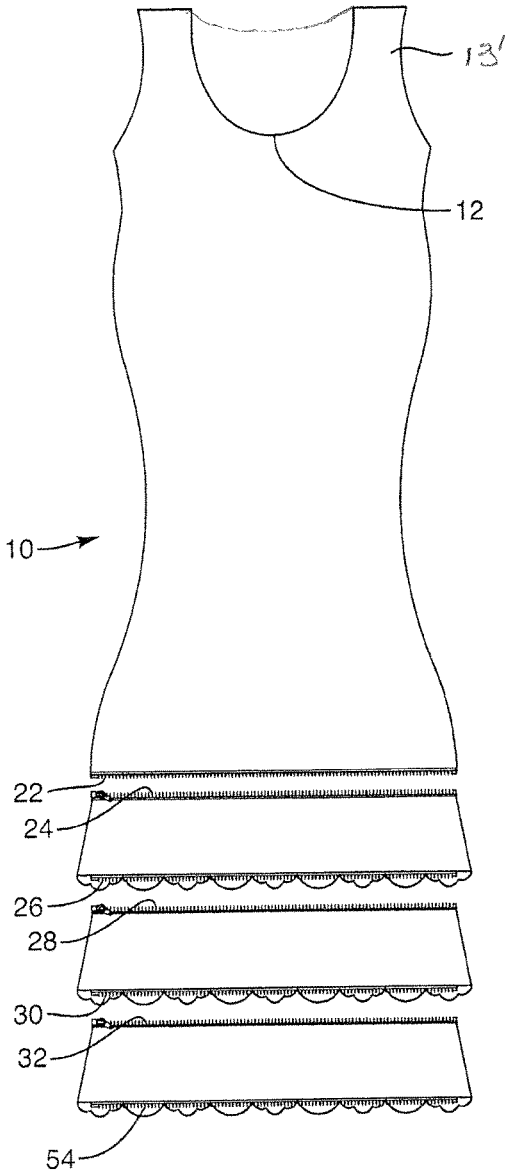
FIG. 2 is an exploded view of an embodiment of slip system, showing features of removable, replaceable sections of the slip system.

FIGS. 1 and 2 show an embodiment of a slip system 10 that comprises a dress. The embodiment of slip system 10 shown in FIG. 1 includes a bodice 11 and skirt 14. The bodice 11 includes an asymmetric, reversible neck line 12 and a strap or sleeve 13. The strap or sleeve 13 is depicted in FIG. 1 as a cap sleeve; FIG. 2 illustrates a strap or sleeve 13' that comprises a tank top strap; other styles of straps and sleeves (e.g., half sleeves, three-quarter sleeves, etc.) are also possible, The bodice 11 may include any suitable type of strap or sleeve 13. In other embodiments, the slip system 10 may comprise a skirt without a bodice or a slip (e.g., a full slip, a half slip, etc.). For the sake of simplicity, the term "skirt," as used here, may refer to any of the skirt of a dress, a standalone skirt, the portion of a full slip that surrounds an individual's waist and hips, and a half slip.

The skirt 14 of the slip system 10 includes a main body 15. The main body 15 of the skirt 14 is capable of surrounding an individual's hips, and may also surround at least portions of her thighs. The main body 15 may have any desired length (e.g., micro, mini, knee-length, etc.) and be of any type or style (e.g., A-line, pencil, pleated, etc.). In addition to the main body 15, the slip system 10 includes at least one removable, replaceable section 16. The embodiment of slip system 10 depicted by FIG. 1 includes three removable, replaceable sections 16, 18, and 20, which are capable of being arranged sequentially to add length to the main body 15 of the skirt 14.

FIG. 2 provides an exploded view of the main body 15 of the skirt 14 and the removable, replaceable sections 16, 18, and 20 of the slip system 10. More specifically, FIG. 2 shows three removable, replaceable sections 16, 18, and 20 in a separated state before they have been attached to each other and to the main body 15 of the skirt 14.

With continued reference to FIGS. 1 and 2, the main body 15 of the skirt 14 of the slip system 10 includes a connector 22, which can receive an upper connector 24 of a first removable, replaceable section 16. In certain non-limiting embodiments, the connector 22 of the main body 15 of the skirt 14 and the upper connector 24 of the first removable, replaceable section 16 may comprise cooperating sides, or halves, of a zipper.

The first removable, replaceable section 16 may also include a lower connector 26, which may cooperate with an upper connector 28 of a second, removable, replaceable section 18 of the slip system 10. The lower connector 26 and the upper connector 28 may comprise cooperating sides, or halves, of a zipper.

Similarly, the second removable, replaceable section 18 may include a lower connector 30, which may cooperate with an upper connector 32 of a third, removable, replaceable section 20 of the slip system 10. The lower connector 30 and the upper connector 32 may also comprise cooperating sides, or halves, of a zipper. The third removable, replaceable section 20 of the slip system may lack a lower connector.

As those of ordinary skill in the art will appreciate, zippers comprise a non-limiting embodiment of connector 22 and upper connector 24, of lower connector 26 and upper connector 28, and/or of lower connector 30 and upper connector 32 (referred to collectively hereinafter as "connectors"). Other embodiments of connectors 22-32 may include, but are not limited to, buttons, ribbons and eyelets, laces and eyelets, snaps, hook and loop fasteners (e.g., those sold under the VELCRO® trademark, etc.), and other touch-type fasteners.

In some embodiments, a pair of cooperating connectors 22 and 24, 26 and 28, 30 and 32 may be visible when a removable, replaceable section 16 is secured to the main body 15 of the skirt 14 or when a removable, replaceable section 18, 20 is secured to another removable, replaceable section 16, 18. The visibility of one or more cooperating pairs of connectors 22 and 24, 26 and 28, 30 and 32 may comprise part of the styling of the skirt 14, particularly when zippers, buttons, laces, or ribbons are used.

Alternatively, as illustrated by FIG. 1, one or more pairs of cooperating connectors 22 and 24, 26 and 28, 30 and 32 may be hidden when a removable, replaceable section 16 is secured to the main body 15 of the skirt 14 or when a removable, replaceable section 18, 20 is secured to another removable, replaceable section 16, 18. A hem or trim at the bottom of the main body 15 and/or the upper adjacent removable, replaceable section 16, 18 of the slip system 10 may overlap an upper portion of the next-lower removable, replaceable section 16, 18, 20, providing the skirt 14 and removable-replaceable sections 16, 18, 20 with a layered appearance, or an imbricate appearance.

Figure 3A:
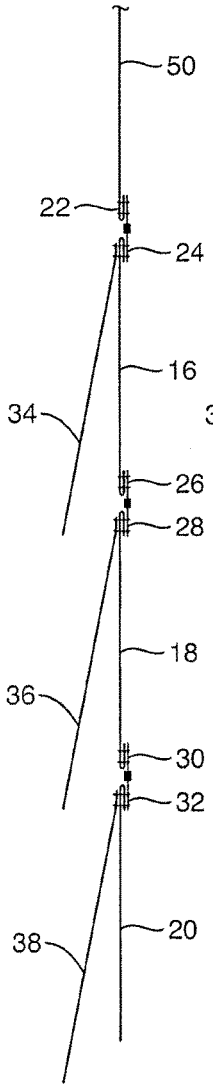
FIG. 3A provides a schematic representation of an embodiment of slip system that includes a main body and three removable, replaceable sections that have been secured together in a desired arrangement.
Figure 3B:
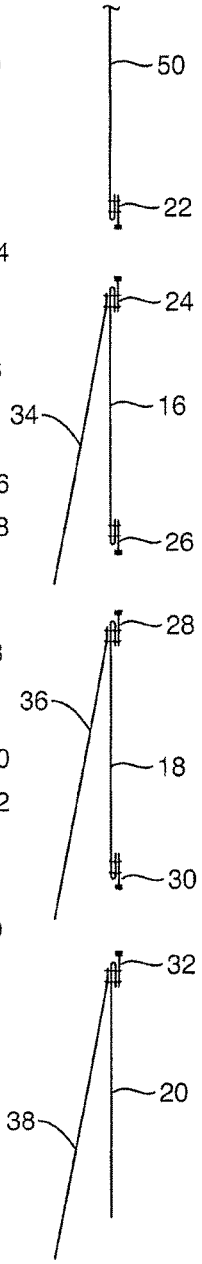
FIG. 3B provides a schematic representation of the embodiment of a slip system shown in FIG. 3A, with the removable, replaceable sections detached from one another.

A layered appearance may be achieved with the main body 15 of a skirt 14 and/or one or more removable, replaceable sections 16, 18, 20 of a slip system 10 of this disclosure in any suitable manner. In a specific embodiment, depicted by FIGS. 3A and 3B, any (or all) of the removable, replaceable sections 16, 18 may include a top layer 34, 36 that substantially covers from view a lower, underlying cooperating pair of connectors 26 and 28, 30 and 32. The main body 15 of the skirt 40 may have a similar configuration. The top layer 34, 36, 38 (of the lowermost removable, replaceable section 20) may have a length that exceeds a length of a main panel of its corresponding removable, replaceable section 16, 18, 20. The excess length of the top layer 34, 36 may extend over and, thus, cover cooperating pairs of lower connectors 26, 30 at or near the hems, or bottom edges, of one or more removable, replaceable sections 16, 18 and upper connectors 28, 32 at or near the top edges of one or more of the next lower removable, replaceable sections 18, 20.

Slip systems 10 with other configurations that hide cooperating pairs of connectors 22 and 24, 26 and 28, 30 and 32 are also possible. Without limitation, lower connectors 22, 26, 30 may be positioned on inside surfaces of the main body 15 and/or one or more removable, replaceable sections 16, 18 of the slip system 10, above the hems of or trim pieces of the main body 15 and/or one or more removable, replaceable sections 16, 18. When positioned in such a manner, an upper connector 22, 26, 30 can engage, mutually engage, or be engaged by a corresponding, complementary upper connector 24, 28, 32 at a location is hidden from view.

Figures 4, 5, 6, 7:
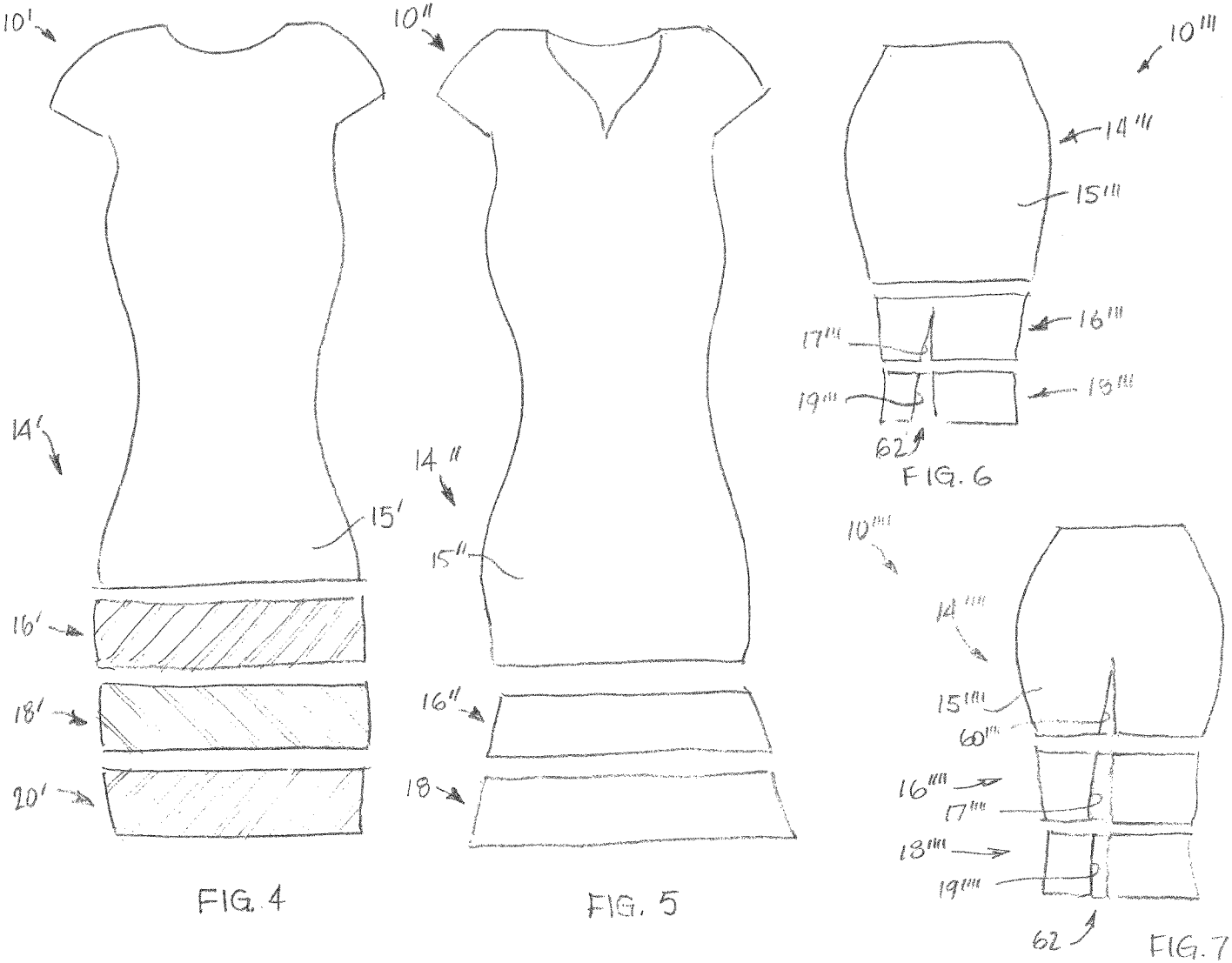
FIGS. 4 and 5 are exploded views of other embodiments of a slip system, in which removable, replaceable sections may vary from the main body of a skirt or a slip or from one another to enable customization of the skirt or slip.
FIG. 6 illustrates an embodiment of a slip system with a removable, replaceable section that introduces a slit into a skirt or a slip.
FIG. 7 illustrates an embodiment of a slip system with a removable, replaceable section that continues a slit in a skirt or a slip as the skirt or slip is lengthened.

FIG. 4 depicts an embodiment of a slip system 10' with one or more removable, replaceable sections 16', 18', 20' that differ from the main body 15' of the skirt 14' in design. For example, one or more of the removable, replaceable sections 16', 18', 20' may have a different color than the main body 15', have a different pattern than the main body 15', or be made from a different fabric than the main body 15'.

FIG. 5 illustrates an embodiment of a slip system 10" with one or more removable, replaceable sections 16", 18" that have a different style from that of the main body 15" of the skirt 14". In the illustrated embodiment, the main body 15" has a pencil style, while the removable, replaceable sections 16" and 18" have an outwardly flared style. Other combinations of styles may be achieved with differently configured main bodies 15" and or removable, replaceable sections 16", 18".

In FIG. 6, a slip system 10''' with removable, replaceable sections 16''', 18''' that provide a skirt 14''' with a slit 62 is depicted. A first removable, replaceable section 16''' may include the top portion 17''' of a slit 62. Such a removable, replaceable section 16''' may be useful with a main body 15''' that lacks a slit. Such a removable, replaceable section 16''' may be configured as a loop. One or more subsequent removable, replaceable sections 18''' may be added to the bottom of the first removable, replaceable section 16''' to extend the slit 62 as the skirt 14''' is lengthened. Each such removable, replaceable section 18''' may comprise a strip rather than a loop.

The embodiment of slip system 10'''' shown in FIG. 7 includes a skirt 14'''' with a main body 15'''' that includes a slit 60". Each removable, replaceable section 16'''', 18'''' that may be added to the bottom of the skirt 14"" may comprise a strip to enable them to define an extended slit 62" as they are added to the bottom of the skirt 14"". The ends 17"", 19"" of each removable, replaceable section 16"", 18"" define edges of the extended slit 62".

Figure 8:
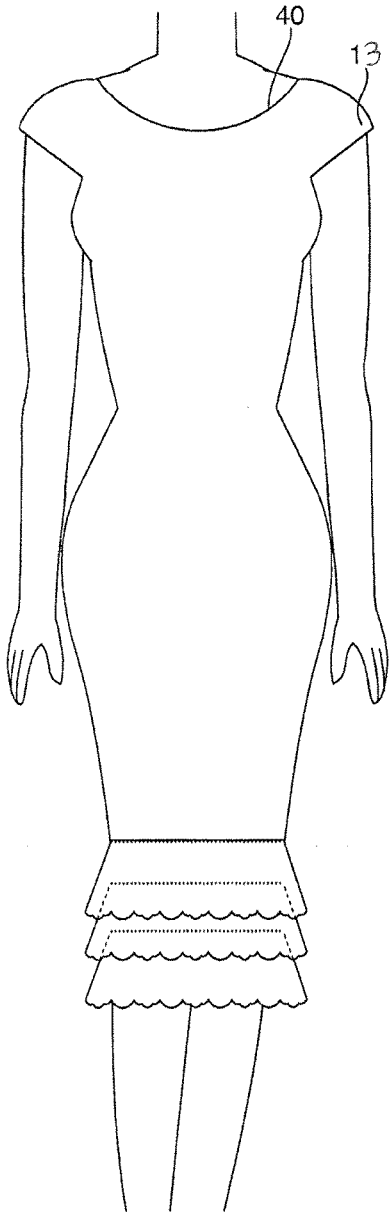
FIG. 8 shows an individual wearing the slip system of FIG. 1 in a reverse orientation from that shown in FIG. 1, providing a different neck line at the "front" of the slip system.

As illustrated by FIGS. 1 and 8, embodiments of slip systems 10 that comprise dresses may include bodices 11 with asymmetric neck lines 12, 40. An assymetric neck line 12, 40 may enable reversal of the slip system 10 from front to back, providing an individual with different options as to which side of the asymmetric neck line 12, 40 will be visible from the individual's front. FIG. 1 shows the slip system 10 with a lower neck line 12 facing forward, while FIG. 8 shows the same slip system 10 with a higher neck line 40 facing forward.

In use, an individual may select one or more removable, replaceable sections for use with a main body of a skirt of a slip system according to this disclosure. The removable, replaceable section(s) may be selected merely to lengthen the skirt, or to provide variation in the design (i.e., color, pattern, fabric, trim, etc.) or style (e.g., shape, etc.) of the skirt. Alternatively, removable, replaceable sections may be removed from the main body of the skirt, and the skirt or the item of clothing of which the skirt is a part, may be worn by itself. Regardless of whether the slip system is worn in a long arrangement, an intermediate arrangement, or a short arrangement, it may be layered with other items of clothing to provide a desired appearance. As an example, it may be worn as a slip beneath a dress or a skirt, other items of clothing may be placed over it, and/or it may be placed over other items of clothing.

Although the preceding disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

What is claimed:

1. A slip system, comprising:

a main body of a skirt or a slip capable of surrounding hips of an individual and including a hem at a lower portion of the main body and a first lower connector at or near the hem;

at least one removable, replaceable section including a first upper connector capable of being removably secured to the first lower connector of the main body, the at least one removable, replaceable section comprising a strip with ends that define at least a portion of a slit when the first upper connector of the removable, replaceable section is secured to the first lower connector of the main body.

2. The slip system of claim 1, wherein the main body comprises a main body of a skirt.

3. The slip system of claim 2, wherein the main body comprises a main body of a skirt of a dress.

4. The slip system of claim 3, wherein a bodice of the dress is reversible from front to back.

5. The slip system of claim 4, wherein the bodice of the dress includes an asymmetric neck line.

6. The slip system of claim 1, wherein the main body comprises a main body of a slip.

7. The slip system of claim 1, wherein the at least one removable, replaceable section includes an upper portion of a slit.

8. The slip system of claim 1, wherein the main body of the skirt or the slip includes a slit and the ends of the strip of the at least one removable, replaceable section are capable of defining an extended portion of the slit.

9. The slip system of claim 1, wherein the at least one removable, replaceable section has a same color, pattern, and/or style as the main body.

10. The slip system of claim 1, wherein at least one of a color, a pattern, and a style of the at least one removable, replaceable section differs from a color, a pattern, or a style of the main body.

11. The slip system of claim 1, wherein the at least one removable, replaceable section includes a second lower connector at or adjacent to a hem of the at least one removable, replaceable section.

12. The slip system of claim 11, comprising at least one additional removable, replaceable section.

13. The slip system of claim 12, wherein the at least one removable, replaceable section overlaps an upper portion of the at least one additional removable, replaceable section when a second upper connector of the at least one additional removable, replaceable section is secured to the second lower connector of the at least one removable, replaceable section.

14. A method for customizing a skirt, comprising:

selecting a main body of the skirt, the main body of the skirt including a slit;

selecting at least one removable, replaceable section comprising a strip to be placed at a bottom of the skirt to extend the slit of the main body of the skirt; and removably securing the at least one removable, replaceable section to the bottom of the body of the skirt to extend the skirt and to extend the slit.

15. The method of claim 14, wherein selecting the at least one removable, replaceable section comprises selecting at least one removable, replaceable section having a cut that modifies a cut of the main body of the skirt.

16. The method of claim 14, further comprising:

removing the at least one removable, replaceable section from the bottom of the skirt.

17. The method of claim 16, further comprising:

selecting another removable, replaceable section; and removably securing the another removable, replaceable section to the bottom of the skirt.

18. A slip system, comprising:

a main body of a skirt or a slip capable of surrounding hips of an individual and including a hem at a lower portion of the main body and a first lower connector at or near the hem;

a plurality of removable, replaceable sections having configurations capable of imparting the main body with a corresponding plurality of different skirt cuts, each removable replaceable section of the plurality of removable, replaceable sections including a first upper connector capable of being removably secured to the first lower connector of the main body.

19. The slip system of claim 18, wherein the main body includes a slip and each removable, replaceable section of the plurality of removable, replaceable sections comprises a strip with ends that define an extended portion of the slit when the first upper connector of the removable, replaceable section is secured to the first lower connector of the main body.

20. The slip system of claim 18, wherein each removable, replaceable section of the plurality of removable, replaceable sections is configured as a loop.

* * * * *